US009914063B1

(12) United States Patent
McCoskery

(10) Patent No.: US 9,914,063 B1
(45) Date of Patent: Mar. 13, 2018

(54) TOY DESIGNED TO SPIN IN A USER'S HAND

(71) Applicant: Michael Scott McCoskery, Suquamish, WA (US)

(72) Inventor: Michael Scott McCoskery, Suquamish, WA (US)

(73) Assignee: MD INTELLECTUAL HOLDINGS LLC, Bainbridge Island, WA (US)

( * ) Notice: Subject to any disclaimer, the term of this patent is extended or adjusted under 35 U.S.C. 154(b) by 0 days.

(21) Appl. No.: 15/592,894

(22) Filed: May 11, 2017

Related U.S. Application Data

(60) Provisional application No. 62/334,879, filed on May 11, 2016.

(51) Int. Cl.

| | |
|---|---|
| ***A63H 1/00*** | (2006.01) |
| ***A63B 67/14*** | (2006.01) |
| ***A63H 33/00*** | (2006.01) |
| ***A63H 29/08*** | (2006.01) |
| ***A63H 1/30*** | (2006.01) |
| ***A63F 9/16*** | (2006.01) |

(52) U.S. Cl.
CPC ..... *A63H 33/00* (2013.01); *A63B 67/14* (2013.01); *A63F 9/16* (2013.01); *A63H 1/00* (2013.01); *A63H 1/30* (2013.01); *A63H 29/08* (2013.01); *A63B 2067/146* (2013.01); *A63B 2208/12* (2013.01)

(58) Field of Classification Search
CPC ..... A63B 67/14; A63B 2208/12; A63B 2067/146; A63H 1/00; A63H 1/30; A63F 9/16
USPC ..... 473/569, 588; 446/233, 236, 250, 256
See application file for complete search history.

(56) References Cited

U.S. PATENT DOCUMENTS

| | | | | | |
|---|---|---|---|---|---|
| 476,825 | A * | 6/1892 | Schwartz | A63B 67/086 | 446/240 |
| 547,764 | A * | 10/1895 | Boyum | A63F 9/16 | 273/147 |
| 1,548,646 | A * | 8/1925 | Akeson | A44C 9/00 | 428/11 |
| 2,454,492 | A * | 11/1948 | Turnbull | A63B 67/14 | 473/587 |
| 2,564,053 | A * | 8/1951 | Donovan | A63H 1/00 | 446/40 |
| 2,879,066 | A * | 3/1959 | Sutherland | A63F 9/16 | 273/147 |
| 3,081,578 | A * | 3/1963 | Mosher | A63H 1/30 | 446/216 |
| 3,206,210 | A * | 9/1965 | Bard | A63F 7/40 | 473/588 |
| 3,287,846 | A * | 11/1966 | Frangos | A63H 1/00 | 446/235 |

(Continued)

*Primary Examiner* — Alexander Niconovich
(74) *Attorney, Agent, or Firm* — Plager Schack LLP

(57) ABSTRACT

A device designed to spin in a user's hands may include a body with a centrally mounted ball bearing positioned within a center orifice of the body, wherein an outer race of the ball bearing is attached to the frame; a button made of a pair of bearing caps attached to one another through the ball bearing and clamped against an inner race of the ball bearing, such that when the button is held between a user's thumb and finger, the body freely rotates about the ball bearing; and a plurality of weights distributed at opposite ends of the body, creating at least a bipolar weight distribution.

14 Claims, 4 Drawing Sheets

(56) References Cited

U.S. PATENT DOCUMENTS 3,565,434 A * 2/1971 Liston ..... A63B 65/08 273/DIG. 4
3,936,974 A * 2/1976 House ..... A63H 1/00 446/250
3,959,989 A * 6/1976 Bhandia ..... A44C 9/02 446/244
5,020,798 A * 6/1991 Yang ..... A63H 1/04 273/440
5,135,425 A * 8/1992 Andrews ..... A63H 33/26 335/306
5,275,410 A * 1/1994 Bellehumeur ..... A63B 67/14 473/588
5,284,343 A * 2/1994 Bigornia ..... A63B 21/0603 473/446
5,318,293 A * 6/1994 Nathanson ..... A63H 1/00 446/236
5,490,678 A * 2/1996 Darnell ..... A63B 65/08 473/590
5,591,062 A * 1/1997 Hettinger ..... A63B 67/086 446/240
5,718,648 A * 2/1998 La Savio ..... A63B 67/14 473/588
5,733,213 A * 3/1998 Colarusso ..... A63B 67/14 473/588
5,976,042 A * 11/1999 Lamarche ..... A63B 67/14 473/588
6,089,998 A * 7/2000 O'Neal ..... A63B 67/14 473/588
6,167,726 B1 * 1/2001 Kremer ..... A44C 9/00 63/15
6,530,817 B1 * 3/2003 Winslow ..... A63H 1/00 446/256
6,592,476 B1 * 7/2003 Bellehumeur ..... A63B 67/14 473/588
7,018,263 B2 * 3/2006 Tiefel ..... A63H 1/06 2/20
7,740,518 B2 * 6/2010 Elliott ..... A63F 9/16 273/126 R
7,874,890 B2 * 1/2011 Van Dan Elzen ..... A63H 1/30 446/247
8,210,895 B2 * 7/2012 Bertrand ..... A63F 9/16 446/259
8,851,954 B2 * 10/2014 McCafferty ..... A63H 1/30 446/250
9,302,195 B2 * 4/2016 Paul ..... A63H 33/002
2005/0064967 A1 * 3/2005 Coleman ..... A63B 67/14 473/588
2015/0140894 A1 * 5/2015 Robustelli ..... A63H 1/30 446/233
2017/0326468 A1 * 11/2017 Kinmont, Jr. ..... A63H 33/26

* cited by examiner

TOY DESIGNED TO SPIN IN A USER'S HAND

RELATED APPLICATION

This application claims priority to provisional patent application U.S. Ser. No. 62/334,879 filed on May 11, 2016 entire contents of which is herein incorporated by reference.

BACKGROUND

The embodiments herein relate generally to toys, and more particularly, to a fidget toy or cessation device configured to spin in a user's hands.

Many people like to keep their hands busy by playing with coins, pens, lighters, knives, fidget toys, or the like. Flipping and spinning things around in one's hand may be a calming activity, and many people use these types of devices as cessation devices or to relieve anxiety. Alternatively, some people enjoy using the devices solely for fun.

Therefore, what is needed is a fidget toy designed to be spun between a user's fingers.

SUMMARY

Some embodiments of the present disclosure include a device designed to spin in a user's hands. The device may comprise a body with a centrally mounted ball bearing positioned within a center orifice of the body, wherein an outer race of the ball bearing is attached to the frame; a button made of a pair of bearing caps attached to one another through the ball bearing and clamped against an inner race of the ball bearing, such that when the button is held between a user's thumb and finger, the body freely rotates about the ball bearing; and a plurality of weights distributed at opposite ends of the body, creating at least a bipolar weight distribution

BRIEF DESCRIPTION OF THE FIGURES

The detailed description of some embodiments of the invention is made below with reference to the accompanying figures, wherein like numerals represent corresponding parts of the figures.

DETAILED DESCRIPTION OF CERTAIN EMBODIMENTS

Figure 1:
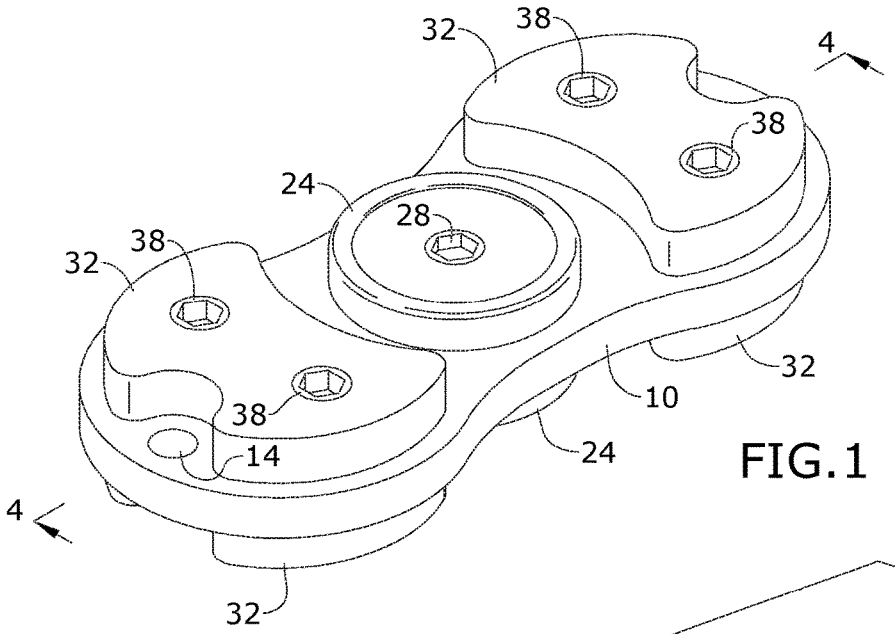
FIG. 1 is a perspective view of one embodiment of the present disclosure.
Figure 2:
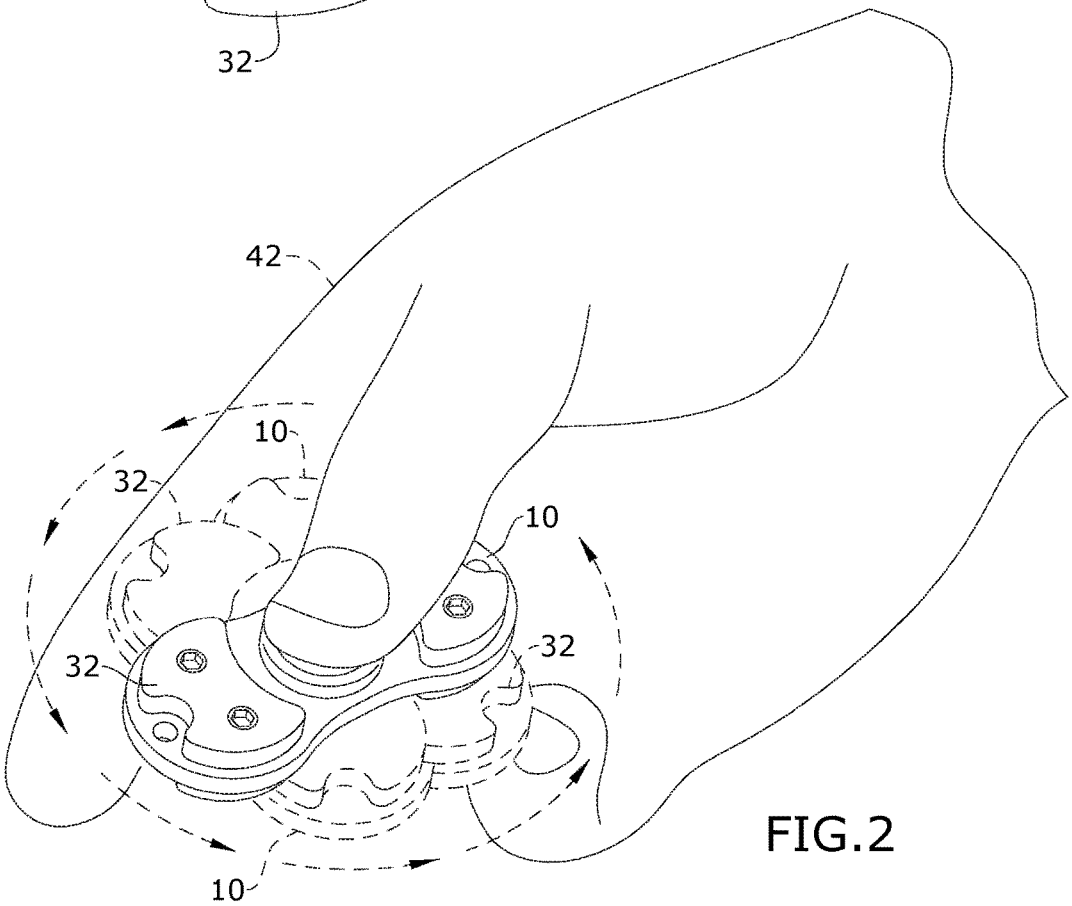
FIG. 2 is a perspective view of one embodiment of the present disclosure.
Figure 3:
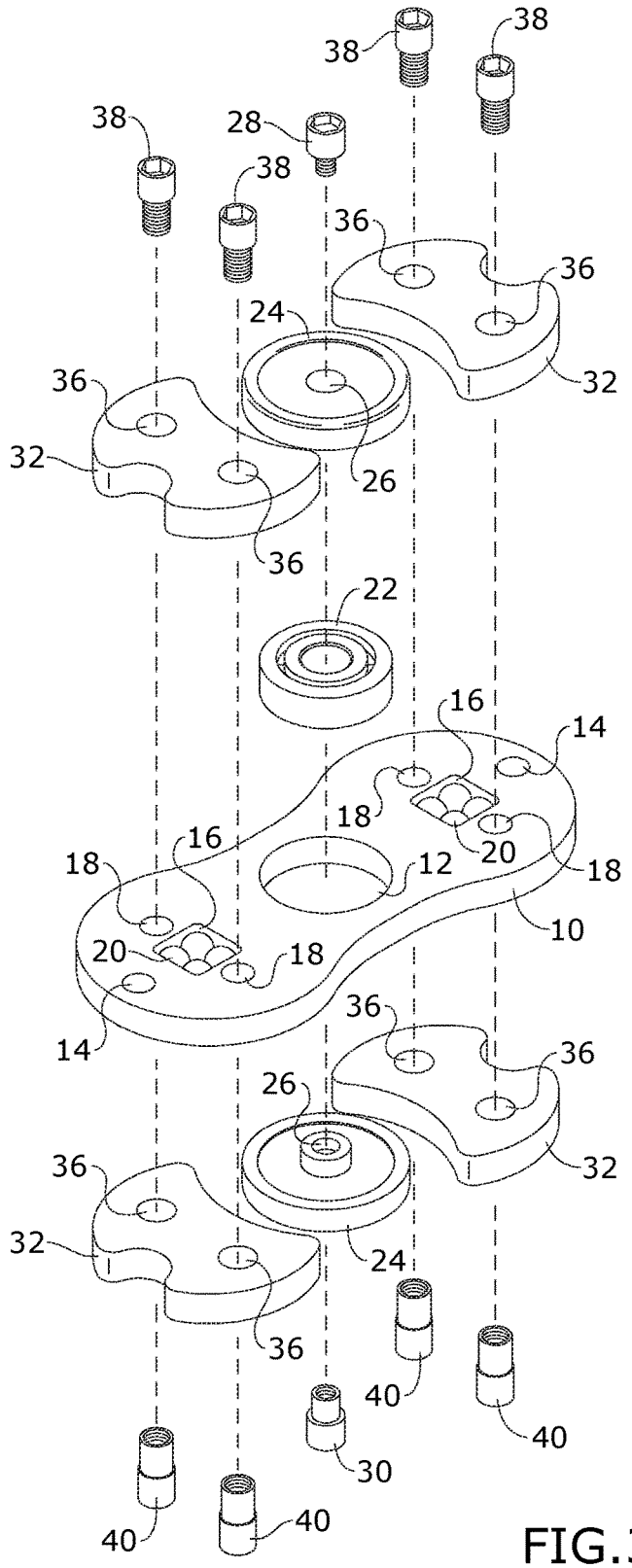
FIG. 3 is an exploded view of one embodiment of the present disclosure.
Figure 4:
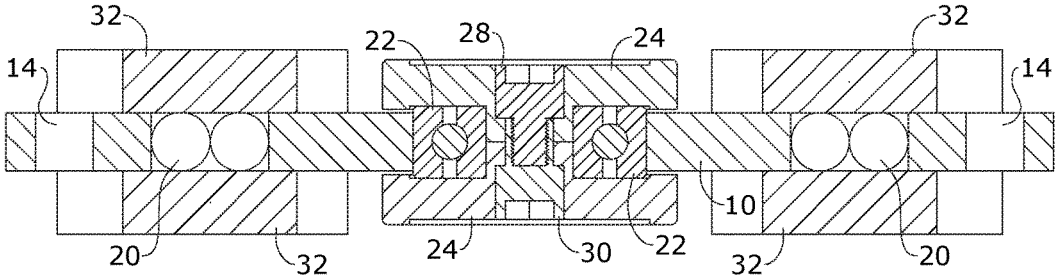
FIG. 4 is a section view of one embodiment of the present disclosure, taken along line 4-4 in FIG. 1.

In the following detailed description of the invention, numerous details, examples, and embodiments of the invention are described. However, it will be clear and apparent to one skilled in the art that the invention is not limited to the embodiments set forth and that the invention can be adapted for any of several applications.

The device of the present disclosure may be used as a fidget toy or a cessation device and may comprise the following elements. This list of possible constituent elements is intended to be exemplary only, and it is not intended that this list be used to limit the device of the present application to just these elements. Persons having ordinary skill in the art relevant to the present disclosure may understand there to be equivalent elements that may be substituted within the present disclosure without changing the essential function or operation of the device.

1. Body
2. Ball Bearing
3. Bearing Cap
4. Weights
5. Balancing Mass

The various elements of the device of the present disclosure may be related in the following exemplary fashion. It is not intended to limit the scope or nature of the relationships between the various elements and the following examples are presented as illustrative examples only.

By way of example, and referring to FIGS. 1-6, some embodiments of the present disclosure include a device designed to spin in a user's hands, the device comprising a body 10 with a centrally mounted ball bearing 22 positioned within a center orifice 12, wherein an outer race of the ball bearing 22 is attached to the frame 10; a button comprising a pair of bearing caps 24 attached to one another through the ball bearing 22 and clamped against an inner race of the ball bearing 22, such that when the button is held between a user's thumb and finger, the body 10 freely rotates about the ball bearing 22; and a plurality of weights distributed at opposite ends of the body 10, creating at least a bipolar weight distribution, which may increase inertia to give the device balance and the ability to spin for a lengthened period of time.

In some embodiments, such as those shown in FIGS. 1-4, the weights 32 may sandwich each end of the body 10, wherein the weights 32 each comprise at least one weight orifice 36, and the body 10 comprises at least one weight mounting orifice 18 designed to align with the at least one weight orifice 36. The weights 32 may be attached to the body 10 by a fastener designed to extend through the weight orifice 36 and the weight mounting orifice 18. For example, a male threaded weight binding screw 38 may extend from a surface of the weight 32, through the weight orifice 36, and into the weight mounting orifice 18, and a female threaded bolt 40 may extend from a surface of the opposite weight 32, through the weight orifice 36, into the weight mounting orifice 18 and engage with the weight binding screw 38 to removably attach weights 32 to the body 10. In such embodiments, the device may further comprise a slot 16, such as a square shaped slot, proximate to each end of the body 10, wherein each slot 16 is sized to accommodate at least one balancing mass, such as a balancing weight ball 20. The weights 32 may then be attached to the frame 10 on either side of the slot 16 to secure the at least one balancing mass within the slot 16. Balancing masses may be added to or removed from the slot 16 at the user's discretion to fine tune the balance of the device.

As described above, the button may comprise a pair of bearing caps 24 attached to one another through the bearing 22 and clamped against the inner race of the bearing 22. In a particular embodiment, each bearing cap 24 may comprise a bearing cap orifice 26 extending through a central point therein, wherein a center bearing screw 18 is designed to extend through one of the bearing caps 24, through the bearing cap orifice 26 and into the center orifice 12, and a center bearing bolt 30 is designed to extend through the other bearing cap 24, through its bearing cap orifice 26, and into the center orifice 12 to engage with the center bearing screw 18, removably attaching the button to the inner race of the bearing 22.

Figure 5:
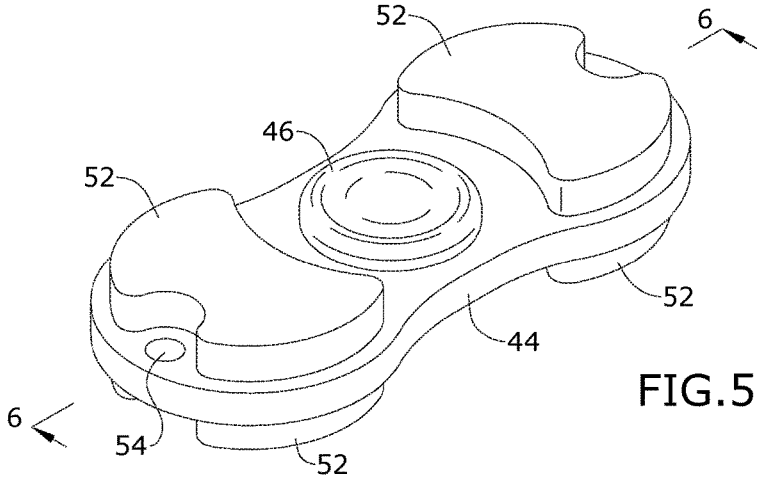
FIG. 5 is a perspective view of one embodiment of the present disclosure.
Figure 6:
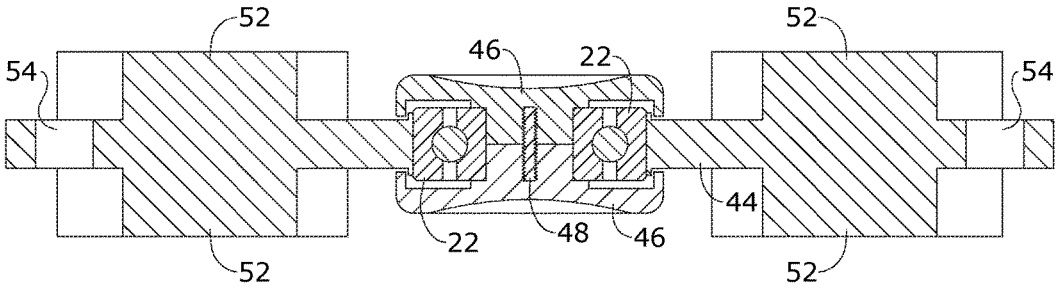
FIG. 6 is a section view of one embodiment of the present disclosure, taken along line 6-6 in FIG. 5.

Alternatively and as shown, for example, in FIGS. 5 and 6, the device may comprise a solid body 44 with built-in, weighted ends 52. The button may comprise a pair of alternate bearing caps 46, wherein the bearing caps 46 are attached to one another by a bearing cap post, such as a threaded bearing cap post 48, wherein the bearing cap post 48 extends through the ball bearing 22 and screwed into each bearing cap 46 to removably attach the bearing caps 46 to one another.

In any embodiment, and as shown in the Figures, the body 10, 44 may further comprise an orifice 14, 54 positioned at each end of the body 10, wherein the orifice 14, 54 may be sized and designed to engage with, for example, a key chain to allow a user to easily carry the device around. While both the slot 16 and orifice 14, 54 are optional, in any case, if a slot 16 or an orifice 14, 54 is included at one end of the body 10, another slot 16 or orifice 14, 54 may be positioned at each end of the body 10 to ensure an equal weight distribution.

While it is described above that the weights 32 and bearing caps 24, 46 may be attached to the body 10 and bearing 22 using screws, bolts, and/or the bearing cap post 48, any suitable fastener may be used to attach the components to one another.

Figure 7:
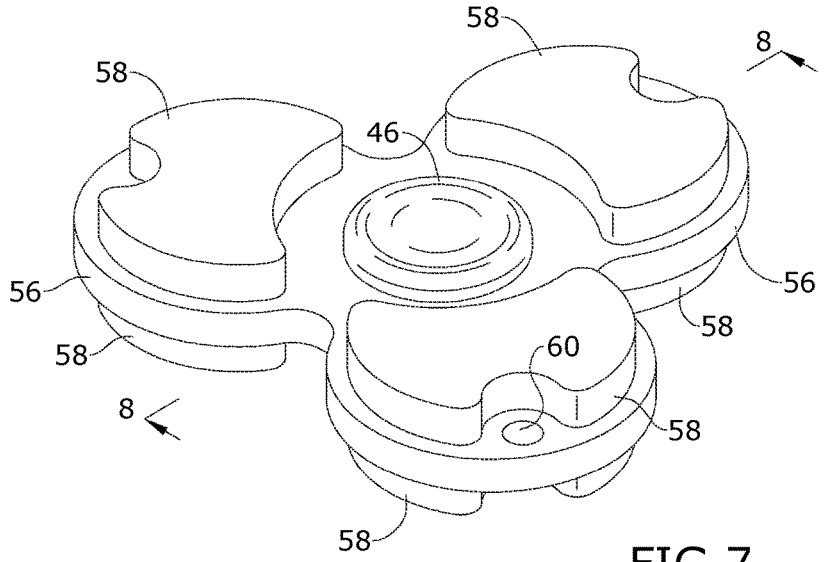
FIG. 7 is a perspective view of one embodiment of the present disclosure.
Figure 8:
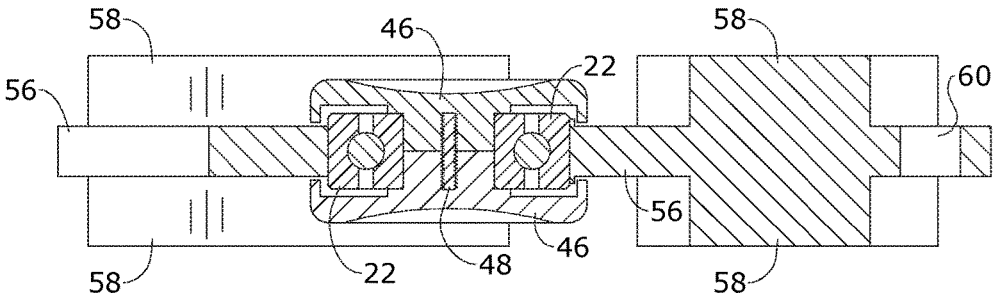
FIG. 8 is a section view of one embodiment of the present disclosure, taken along line 8-8 in FIG. 7.

As shown in FIGS. 1-6, the body 10 may have a rounded hourglass shape, wherein each end is rounded and the middle area is concave. Thus, some embodiments of the body 10 may have two opposite ends and may thus have a bipolar weight distribution. However, other embodiments of the body 10, such as that shown in FIGS. 7 and 8, may have three ends 56, similar to a three-sided boomerang and may therefore have a tri-polar weight distribution, wherein each of the three ends 56 has an orifice 60 extending therethrough, similar to orifices 14, 54 in the bipolar version. In fact, the device may have as many ends as desired, so long as the weight is evenly distributed. Additionally, the weights 32 may have any desired shape, size, and weight, so long as the weight distribution remains equal on each end of the body 10. The device may be made of any suitable or desired materials.

To use the device of the present disclosure, a user 42 may grasp the button between the thumb and index or middle finger. The body 10 may then be flicked with the user's other fingers to spin the body 10 freely while holding the button 18.

Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. A device designed to spin in a user's hands, the device comprising:

a planar body with a centrally mounted ball bearing positioned within a center orifice of the planar body, wherein an outer race of the ball bearing is attached to the planar body;

a button comprising a pair of bearing caps attached to one another through the ball bearing and clamped against an inner race of the ball bearing, such that when the button is held between a user's thumb and finger, the planar body freely rotates about the ball bearing; and a plurality of weights distributed at opposite ends of the planar body, creating at least a bipolar weight distribution.

2. The device of claim 1, wherein the planar body has a rounded hour glass shape with a bipolar weight distribution.

3. The device of claim 1, wherein:

the plurality of weights comprises two weights sandwiching each end of the planar body;

each weight comprises at least one weight orifice;

the planar body comprises at least one weight mounting orifice on each end designed to align with the at least one weight orifice in each weight; and a fastener extends through a first weight, through the at least one weight mounting orifice, and the second weight to attach the first weight and the second weight to the planar body.

4. The device of claim 3, wherein the fastener comprises a female threaded bolt designed to engage with a male threaded screw.

5. The device of claim 3, further comprising a slot in each end of the planar body sized to accommodate at least one balancing mass, wherein the slot is positioned between the two weights sandwiching each end.

6. The device of claim 1, wherein:

the pair of bearing caps comprises a first bearing cap and a second bearing cap;

the first bearing cap comprises a first bearing cap orifice and the second bearing cap comprises a second bearing cap orifice;

a center bearing screw extends through the first bearing cap, through the first bearing cap orifice and into the center orifice; and a center bearing bolt extends through the second bearing cap, through the second bearing cap orifice, and into the center orifice to engage with the center bearing screw.

7. The device of claim 1, wherein the planar body is a solid body and the plurality of weights are built-in to the solid body.

8. The device of claim 7, wherein the pair of bearing caps are attached to one another by a bearing cap post, wherein the bearing cap post extends through the ball bearing and screws into each bearing cap.

9. The device of claim 1, wherein the planar body comprises a member selected from the group consisting of a bi-polar distribution with two weighted ends and a tri-polar distribution with three weighted ends.

10. The device of claim 1, wherein the planar body is hub-and-spoke shaped.

11. The device of claim 1, wherein the planar body is a singular planar body.

12. The device of claim 1, wherein:

each of the plurality of weights is spaced from a center of the planar body towards each end of the planar body; and a shape of each of the plurality of weights mimics a shape of each end of the planar body.

13. A device designed to spin in a user's hands, the device comprising:

a body with a centrally mounted ball bearing positioned within a center orifice of the body, wherein an outer race of the ball bearing is attached to the body;

a button comprising a pair of bearing caps attached to one another through the ball bearing and clamped against an inner race of the ball bearing, such that when the button is held between a user's thumb and finger, the body freely rotates about the ball bearing; and a plurality of weights distributed at opposite ends of the body, creating at least a bipolar weight distribution, wherein:

the body is hub-and-spoke shaped.

14. The device of claim 13, wherein the body has a planar hub-and-spoke shape.

* * * * *